US006769491B2

(12) United States Patent
Zimmerman et al.

(10) Patent No.: US 6,769,491 B2
(45) Date of Patent: Aug. 3, 2004

(54) ANCHORING AND SEALING SYSTEM FOR A DOWNHOLE TOOL

(75) Inventors: Patrick J. Zimmerman, Houston, TX (US); Rocky A. Turley, Houston, TX (US); Rami Al Oudat, Huntsville, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 33 days.

(21) Appl. No.: 10/165,613

(22) Filed: Jun. 7, 2002

(65) Prior Publication Data

US 2003/0226668 A1 Dec. 11, 2003

(51) Int. Cl.[7] ..... E21B 33/129; E21B 33/12

(52) U.S. Cl. ..... 166/387; 166/138; 166/140; 166/196; 277/339

(58) Field of Search ..... 166/381, 387, 166/118, 135, 138, 140, 192, 195, 196; 277/336, 337, 338, 339

(56) References Cited

U.S. PATENT DOCUMENTS

| | | | | |
|---|---|---|---|---|
| 2,306,160 A | | 12/1942 | Freyssinet | 288/6 |
| 2,519,116 A | | 8/1950 | Crake | 166/10 |
| 2,656,891 A | | 10/1953 | Toelke | 166/13 |
| 2,751,017 A | | 6/1956 | Baker et al. | 166/216 |
| 2,814,517 A | | 11/1957 | Razdow | 288/20 |
| 3,054,450 A | | 9/1962 | Baker | 166/120 |
| 3,061,013 A | | 10/1962 | Thomas, Jr. | 166/204 |
| 3,109,493 A | | 11/1963 | Carter | 166/204 |
| 3,147,016 A | | 9/1964 | Traufler | 277/226 |
| 3,298,440 A | | 1/1967 | Current | 166/123 |
| 3,507,327 A | | 4/1970 | Chenoweth | 166/134 |
| 3,623,551 A | | 11/1971 | Randermann, Jr. | 166/134 |
| 3,666,010 A | * | 5/1972 | Harris | 166/134 |
| 3,678,998 A | | 7/1972 | Cockrell et al. | 166/123 |
| 3,690,375 A | | 9/1972 | Shillander | 166/187 |
| 4,078,606 A | | 3/1978 | Montgomery | 166/120 |
| 4,146,093 A | | 3/1979 | Horvath et al. | 166/120 |
| 4,151,875 A | * | 5/1979 | Sullaway | 166/126 |
| 4,153,109 A | | 5/1979 | Szescila | 166/250 |
| 4,224,987 A | | 9/1980 | Allen | 166/120 |
| 4,253,676 A | | 3/1981 | Baker et al. | 277/34.6 |
| 4,281,840 A | * | 8/1981 | Harris | 277/342 |
| 4,289,200 A | | 9/1981 | Fisher, Jr. | 166/120 |
| 4,300,775 A | | 11/1981 | Ringel | 277/34.3 |
| 4,345,649 A | | 8/1982 | Baugh et al. | 166/120 |
| 4,353,420 A | | 10/1982 | Miller | 166/382 |
| 4,375,240 A | | 3/1983 | Baugh et al. | 166/387 |

(List continued on next page.)

FOREIGN PATENT DOCUMENTS

| | | | |
|---|---|---|---|
| EP | 0 237 662 | 9/1987 | E21B/34/10 |
| EP | 0 570 157 | 11/1993 | E21B/33/129 |
| EP | 0 959 226 A2 | 11/1999 | E21B/33/12 |
| FR | 2 377 518 | 8/1978 | E21B/33/128 |
| FR | 2 586 781 | 6/1987 | F16J/15/34 |
| GB | 1 398 038 | 6/1975 | E21B/33/128 |
| WO | WO 98/45635 | 10/1998 | F16L/11/08 |

OTHER PUBLICATIONS

PCT Search Report, International Application No. PCT/GB 03/02298, dated Oct. 6, 2003.

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

The present invention generally relates to a method and apparatus for sealing an annulus in a wellbore. In one aspect, the apparatus is an anchoring and sealing system for a downhole tool such as a bridge plug, packer, or frac-plug. The sealing system comprises of a sealing member disposed between a set of energizing rings, a set of expansion rings adjacent each cone, a set of support rings, and a set of slips. The components of the sealing system are arranged such that, when compressed, the sealing member may expand radially into contact with a casing. In another aspect, the apparatus the invention provides for an apparatus that is a downhole sealing tool.

26 Claims, 5 Drawing Sheets

U.S. PATENT DOCUMENTS 4,403,660 A 9/1983 Coone ..... 166/387
4,406,469 A 9/1983 Allison ..... 277/123
4,436,150 A 3/1984 Barker ..... 166/131
4,452,463 A 6/1984 Buckner ..... 277/120
4,457,369 A 7/1984 Henderson ..... 166/125
4,487,258 A 12/1984 Jackson et al. ..... 166/120
4,499,947 A 2/1985 Zsoka et al. ..... 166/179
4,540,047 A 9/1985 Akkerman ..... 166/188
4,573,537 A 3/1986 Hirasuna et al. ..... 166/387
4,601,498 A 7/1986 Haugen ..... 285/332.5
4,640,351 A 2/1987 Clifton et al. ..... 166/127
4,662,450 A 5/1987 Haugen ..... 166/299
4,674,570 A 6/1987 Jackson ..... 166/187
4,708,202 A 11/1987 Sukup et al. ..... 166/123
4,730,670 A 3/1988 Kim ..... 166/134
4,749,035 A 6/1988 Cassity ..... 166/120
4,753,444 A 6/1988 Jackson et al. ..... 277/230
4,762,179 A 8/1988 Wesson et al. ..... 166/297
4,784,226 A 11/1988 Wyatt ..... 166/376
4,834,175 A 5/1989 Ross et al. ..... 166/120
4,834,184 A * 5/1989 Streich et al. ..... 166/376
4,886,117 A 12/1989 Patel ..... 166/187
4,898,239 A 2/1990 Rosenthal ..... 166/133
4,907,651 A 3/1990 Bou-Mikael ..... 166/114
4,913,232 A 4/1990 Cheymol et al. ..... 166/285
5,024,270 A * 6/1991 Bostick ..... 166/63
5,044,441 A 9/1991 Rubbo et al. ..... 166/382
5,165,703 A 11/1992 Morvant ..... 277/188 A
5,224,540 A * 7/1993 Streich et al. ..... 166/118
5,226,492 A 7/1993 Solaeche et al. ..... 166/196
5,271,468 A * 12/1993 Streich et al. ..... 166/387
5,271,469 A 12/1993 Brooks et al. ..... 166/387
5,309,993 A 5/1994 Coon et al. ..... 166/115
5,311,938 A 5/1994 Hendrickson et al. ..... 166/134
5,332,038 A 7/1994 Tapp et al. ..... 166/278
5,390,737 A * 2/1995 Jacobi et al. ..... 166/184
5,433,269 A 7/1995 Hendrickson ..... 166/134
5,511,620 A 4/1996 Baugh et al. ..... 166/387
5,540,279 A * 7/1996 Branch et al. ..... 166/188
5,542,473 A 8/1996 Pringle et al.
5,605,195 A 2/1997 Eslinger et al. ..... 166/387
5,620,050 A 4/1997 Barbee ..... 166/278
5,636,689 A 6/1997 Rubbo et al. ..... 166/123
5,676,384 A 10/1997 Culpepper ..... 277/188 A
5,678,635 A 10/1997 Dunlap et al. ..... 166/387
5,701,959 A * 12/1997 Hushbeck et al. ..... 166/387
5,711,372 A 1/1998 Stokley ..... 166/187
5,749,585 A 5/1998 Lembcke ..... 277/116.2
5,775,429 A 7/1998 Arizmendi et al. ..... 166/387
5,787,987 A 8/1998 Forsyth et al. ..... 166/313
5,803,179 A 9/1998 Cain ..... 166/306
5,810,082 A 9/1998 Jordan, Jr. ..... 166/120
5,819,846 A 10/1998 Bolt, Jr. ..... 166/123
5,833,001 A 11/1998 Song et al. ..... 166/287
5,857,520 A * 1/1999 Mullen et al. ..... 166/196
5,875,841 A 3/1999 Wright et al. ..... 166/85.4
5,875,847 A 3/1999 Forsyth ..... 166/313
5,941,313 A 8/1999 Arizmendi ..... 166/387
6,009,951 A 1/2000 Coronado et al. ..... 166/387
6,041,858 A 3/2000 Arizmendi ..... 166/187
6,102,117 A 8/2000 Swor et al. ..... 166/138
6,116,339 A 9/2000 Milne et al. ..... 166/125
6,167,963 B1 * 1/2001 McMahan et al. ..... 166/179
6,220,349 B1 * 4/2001 Vargus et al. ..... 166/138
6,244,642 B1 6/2001 Serafin et al. ..... 294/86.17
6,318,461 B1 11/2001 Carisella ..... 166/196
6,394,180 B1 * 5/2002 Berscheidt et al. ..... 166/193
6,598,672 B2 * 7/2003 Bell et al. ..... 166/118
2002/0043368 A1 4/2002 Bell et al. ..... 166/118
2003/0000710 A1 * 1/2003 Turley et al. ..... 166/386

* cited by examiner

ANCHORING AND SEALING SYSTEM FOR A DOWNHOLE TOOL

BACKGROUND OF THE INVENTION

1. Field of the Invention

The present invention relates to a method and apparatus used in the completion of a well. More particularly, the invention relates to downhole tools. More particularly still, the present invention relates to downhole tools having an anchoring and sealing system.

2. Description of the Related Art

Hydrocarbon wells are typically formed with a central wellbore that is supported by steel casing. The casing lines a borehole formed in the earth during the drilling process. An annular area formed between the casing and the borehole is filled with cement to further support and form the wellbore. Typically, wells are completed by perforating the casing of the wellbore at selected depths where hydrocarbons are found. Hydrocarbons migrate from the formation through the perforations and into the wellbore where they are usually collected in a separate string of production tubing for transportation to the surface of the well.

Downhole tools with sealing systems are placed within the wellbore to isolate producing zones or to direct the flow of production fluids to the surface. Examples of sealing tools are plugs and packers. The sealing tools are usually constructed of cast iron, aluminum, or other drillable alloyed metals. The sealing tools typically contain a sealing system. The sealing system includes a sealing element that is typically made of a composite or elastomeric material that seals off an annulus within the wellbore to prevent the passage of fluids. The sealing element is compressed causing the sealing element to expand radially outward from the tool to sealingly engage a surrounding surface of the tubular. In one example, a bridge plug is placed within the casing to isolate upper and lower sections of production zones. By creating a pressure seal in the wellbore, bridge plugs allow pressurized fluids or solids to treat an isolated formation.

U.S. patent application Ser. No. 09/983,505, filed on Jun. 27, 2001 discloses a method and apparatus for a non-metallic sealing system, and is incorporated herein by reference in its entirety. In one aspect, the sealing element system defines a frac-plug used to seal a wellbore within the casing during a fracturing operation FIG. 1 is a partial cross-section view of a plug from a pending patent application of the same assignee. The frac-plug 10 includes a sealing system 15 disposed around a mandrel 20. The sealing system 15 serves to seal an annular area between the frac-plug 10 and an inner wall of a casing (not shown) upon activation of the tool. The sealing system 15 includes a set support rings 65, 70 to contain a sealing element 95 upon activation of the frac-plug 10. The support rings 65, 70 are disposed on the mandrel 20 and located on the tapered surface of expansion rings 75, 80. The expansion rings 75, 80 fill in gaps that are created during the expansion of the sealing element 95. The sealing system 15 further provides inner cones 85, 90. The inner cones 85, 90 are disposed about the mandrel 20 adjacent each end of the sealing member 95. A tapered edge on the inner cones 85, 90 urge the expansion rings 75, 80 radially outward upon activation of the frac-plug 10.

The frac-plug 10 also has an anchoring system that includes a pair of cones 45, 50, a pair of slips 35, 40, a top ring 30 and a setting ring 25. Upon activation of the frac-plug 10, the cones 45, 50 are used to urge slips 35, 40 radially outward into contact with the surrounding casing, thereby securing the frac-plug 10 in the wellbore.

Typically, the frac-plug 10 is intended for temporary use and must be removed to access the wellbore there below. Rather than de-actuate the slips 35, 40 and bring the frac-plug 10 to the surface of the well, the frac-plug 10 is typically destroyed with a rotating milling or drilling device. As the mill contacts the tool, the tool is "drilled up" or reduced to small pieces that are either washed out of the wellbore or simply left at the bottom of the wellbore. The more parts making up the tool, the longer the milling operation takes. In this manner, the use of cones 45, 50 increase the time required for the milling operation.

The frac-plug 10 is actuated by a separate setting tool (not shown). The setting tool is run into the hole with the frac-plug 10. The setting tool operates to set the frac-plug 10 by applying opposing forces to the inner mandrel 20 and the setting ring 30. In operation, the inner diameter of a setting tool straddles the top ring 25. The lower end of the setting tool abuts against setting ring 30. A force is applied to the setting tool from the surface causing the lower end of the setting tool to push axially downward against the setting ring 30. At the same time, the inner diameter of the tool pulls up on the mandrel 20. The opposing forces urge the slips 35, 40 to ride up cones 45, 50 allowing the outer portion of the slips 35, 40 to contact the inner surface of the casing. In turn, the expansion rings 75, 80 ride up the tapered surfaces of cones 85, 90, thereby causing the sealing member 95 to expand outwardly into contact with the casing. In this manner, the compressed sealing member 95 provides a fluid seal to prevent movement of fluids across the frac-plug 10 and the frac-plug 10 is anchored in the wellbore.

Like the frac-plug in the previous paragraph, conventional packers and bridge plugs typically comprise a sealing system located between upper and lower cone members. Packers are typically used to seal an annular area formed between two co-axially disposed tubulars within a wellbore. For example, packers may seal an annulus formed between the production tubing and the surrounding wellbore casing. Alternatively, packers may seal an annulus between the outside of a tubular and an unlined borehole. Routine uses of packers include the protection of casing from well and stimulation pressures, and the protection of the wellbore casing from corrosive fluids. Other common uses include the isolation of formations or leaks within a wellbore casing or multiple producing zones, thereby preventing the migration of fluid between zones.

One problem associated with conventional sealing systems of downhole tools arises when the tool is no longer needed to seal the wellbore, and must be removed from the well. For example, plugs and packers are sometimes intended to be temporary and must be removed to access the wellbore there below. Rather than de-actuate the tool and bring it to the surface of the well, the tool is typically destroyed with a rotating milling or drilling device. As the mill contacts the tool, the tool is "drilled up" or reduced to small pieces that are either washed out of the wellbore or simply left at the bottom of the hole. The more parts making up the tool, the longer the milling operation takes. Longer milling time leads to an increase in wear and tear of the drill bit and additional expensive rig time. When the tool comprises of many parts, multiple trips in and out of the wellbore are required to replace worn out mills or drill bits.

Another problem associated with conventional metallic and non-metallic sealing systems is the manufacturing cost. Additional parts increase the cost and complexity of a tool.

There is a need, therefore, for a sealing system for use in a downhole tool that will minimize the time of a milling operation upon removal of the tool, and subsequently reduce the wear and tear on the drill bit. There is a further need for a sealing element with fewer components, thereby reducing the cost to manufacture. Still further, a need exists for a plug wherein the upper and lower cones have been removed.

SUMMARY OF THE INVENTION

The present invention generally relates to a method and apparatus for sealing a wellbore. In one aspect, the invention provides for an apparatus that is an anchoring and sealing system for use in a downhole tool. The anchoring and sealing system comprises of a compressible sealing member, a ring member at each end of the sealing member, and a slip member adjacent to each ring member. During activation of the anchoring and sealing system, the sealing member expands out and the slip member moves radially outward along an outer surface of the ring member into frictional contact with an adjacent surface of the wellbore, thereby supporting the expanding sealing member.

In another aspect, the invention provides for an apparatus that is a downhole sealing tool. As with the tool 10 of FIG. 1, the downhole tool comprises a body and an anchoring and sealing system disposed about the body. However, the tool of the present invention does not include upper and lower cones. Rather, support rings in the sealing and anchoring system are constructed and arranged to permit the radial expansion of a set of slips. In this manner, the manufacturing cost of the tool is reduced and the milling time to remove the tool from the wellbore is reduced.

A method is further provided for sealing an annulus in a wellbore. The method comprises running a tool into the wellbore, the tool comprising a sealing system having a sealing member disposed between a set of energizing rings, a set of expansion rings adjacent each set of energizing rings, a set of support rings, and a set of slips. The method further comprises activating the tool causing the sealing member to expand and the slip member to move radially outwards along an outer surface of the support rings, thereby supporting the expanding sealing member.

BRIEF DESCRIPTION OF THE DRAWINGS

So that the manner in which the above recited features and advantages of the present invention are attained and can be understood in detail, a more particular description of the invention, briefly summarized above, may be had by reference to the appended drawings. It is to be noted, however, that the appended drawings illustrate only typical embodiments of this invention, and are therefore not to be considered limiting of its scope, for the invention may admit to other equally effective embodiments.

DETAILED DESCRIPTION OF THE PREFERRED EMBODIMENT

Figure 1:
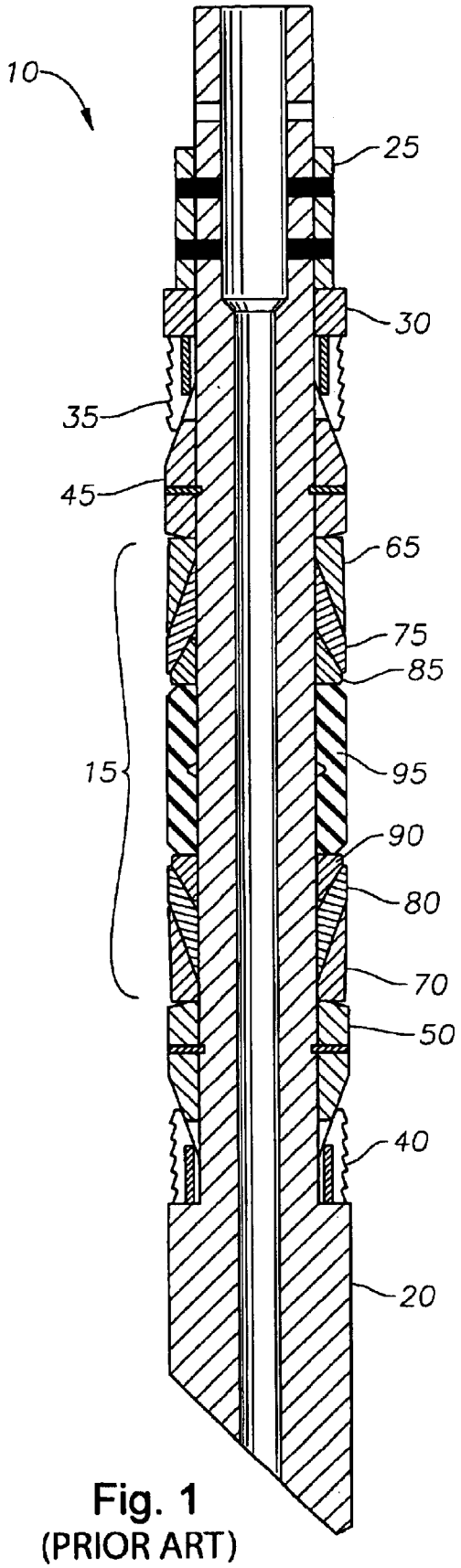
Fig. 1 (PRIOR ART)
FIG. 1 is a partial cross-section view of a plug from a pending patent application Ser. No. 09,983,505 of the same assignee.
Figure 2:
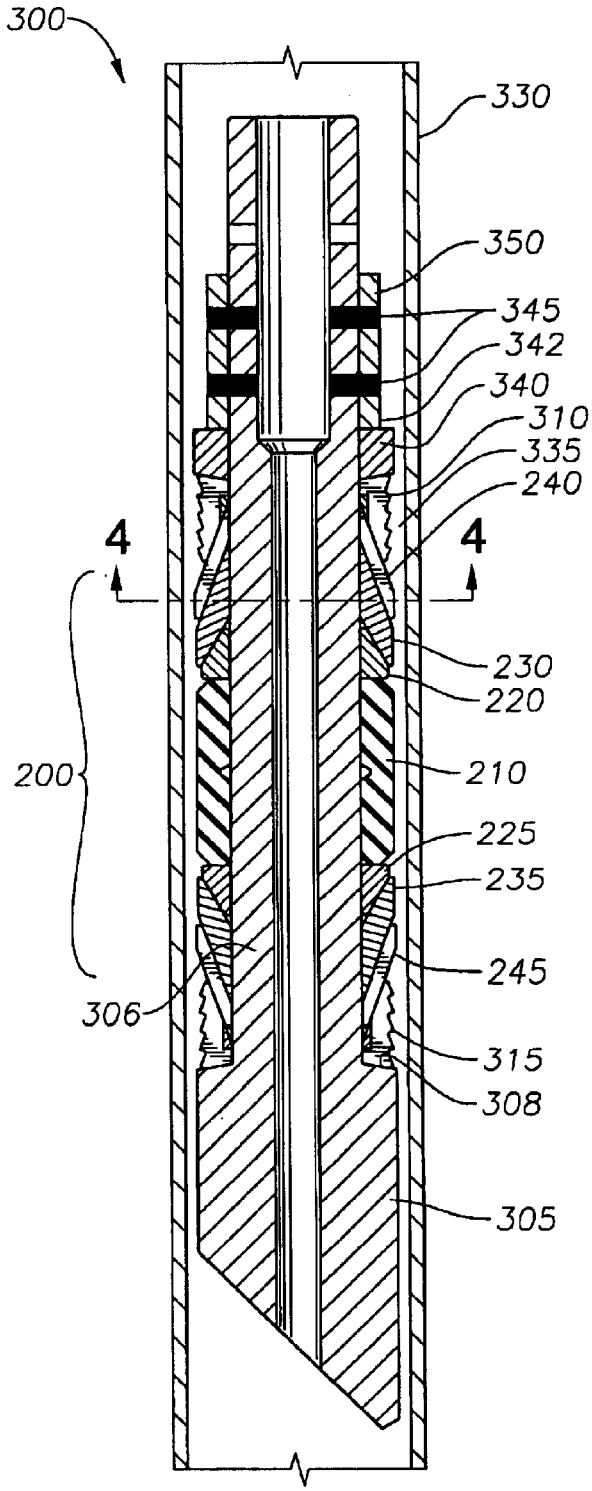
FIG. 2 presents a longitudinal cross-section view of one embodiment of a sealing and anchoring system of the present invention in a sealing apparatus.

FIG. 2 presents a longitudinal cross-section view of one embodiment of a sealing and anchoring system 200 of the present invention in a sealing apparatus 300. The sealing apparatus 300 is disposed in a string of casing 330. As illustrated, the sealing apparatus 300 is shown as a bridge plug; however it should be noted that the sealing apparatus 300 could be a packer or a frac-plug or any other device used to seal off a wellbore.

The following is a brief overview of the sealing apparatus 300; each component will be discussed in greater detail in subsequent paragraphs. The sealing apparatus 300 comprises of a mandrel 305 or body that acts as a center support member for the apparatus 300. The apparatus 300 also includes an anchoring and sealing system 200 disposed on the mandrel 305. The anchoring and sealing system 200 has two functions. The first function is to act as a sealing device to seal off a portion of the casing 330. The second function is to act as an anchoring device to secure the sealing apparatus 300 within the string of casing 330. The apparatus 300 further includes a setting ring 340 and a top ring 350 that is later used to activate the anchoring and sealing system 200.

The mandrel 305 of the sealing apparatus 300 defines an elongated tubular body. In the preferred embodiment, the mandrel 305 consists of a nonmetallic material. The non-metallic characteristics allow the mandrel 305 to be "drilled up" quickly during the milling operation in the removal of the apparatus 300 from the casing 330. However, a metallic mandrel may also be employed, so long as it is capable of supporting the weight the anchoring and sealing system 200. Additionally, the mandrel 305 may be hollow or solid depending on the application. For example, if the sealing system 200 is used for a packer, the mandrel 305 will be solid. Conversely, if the sealing system 200 is used for a frac-plug the mandrel 305 will be hollow as illustrated on FIG. 2.

In one arrangement, the mandrel 305 has an upper end having a first outer diameter, and a lower end having a second outer diameter. The first diameter forms the body 306 of the mandrel 305 and the second diameter forms a shoulder 308. As will be discussed below, the shoulder 308 serves as a no-go that acts against the sealing system 200.

As shown on FIG. 2, the anchoring and sealing system 200 consists of several components. The components may be fabricated of either metallic or nonmetallic components. However, in the preferred embodiment, the anchoring and sealing system 200 is a non-metallic sealing system that is capable of sealing an annulus 335 in very high or low pH environments as well as at elevated temperatures and high-pressure differentials. The non-metallic anchoring sealing system 200 is made of a fiber reinforced polymer composite that is compressible and expandable or otherwise malleable to create a permanent set position.

The composite material is constructed of a polymeric composite that is reinforced by a continuous fiber such as glass, carbon, or aramid, for example. The individual fibers are typically layered parallel to each other, and wound layer upon layer. However, each individual layer is wound at an angle of about 30 to about 70 degrees to provide additional strength and stiffness to the composite material in high temperature and pressure downhole conditions. The mandrel 305 in the sealing apparatus 300 is preferably wound at an angle of 30 to 55 degrees, and the other components are preferably wound at angles between about 40 and about 70 degrees. The difference in the winding phase is dependent on the required strength and rigidity of the overall composite material.

The polymeric composite material used in the anchoring and sealing system 200 is preferably an epoxy blend. However, the polymeric composite may also consist of polyurethanes or phenolics, for example. In one aspect, the polymeric composite is a blend of two or more epoxy resins. Preferably, the composite is a blend of a first epoxy resin of bisphenol A and epichlorohydrin and a second cycoaliphatic epoxy resin. Preferably, the cycloaphatic epoxy resin is ARALDITE® liquid epoxy resin, commercially available from Ciga-Geigy Corporation of Brewster, New York. A 50:50 blend by weight of the two resins has been found to provide the required stability and strength for use in high temperature and pressure applications. The 50:50 epoxy blend also provides good resistance in both high and low pH environments.

The fiber is typically wet wound, however, a prepreg roving can also be used to form a matrix. A post cure process is preferable to achieve greater strength of the material. Typically, the post cure process is a two stage cure consisting of a gel period and a cross linking period using an anhydride hardener, as is commonly know in the art. Heat is added during the curing process to provide the appropriate reaction energy, which drives the cross-linking of the matrix to completion. The composite may also be exposed to ultra-violet light or a high-intensity electron beam to provide the reaction energy to cure the composite material.

As illustrated on FIG. 2, the sealing and anchoring system includes a sealing member 210. The sealing member 210 is typically made of a composite or elastomeric material. The sealing member 210 may have any number of configurations to effectively seal an annulus within the wellbore. For example, the sealing member 210 may include grooves, ridges, indentations, or protrusions designed to allow the sealing member 210 to conform to variations in the shape of the interior of a surrounding casing 330. Typically, the sealing member 210, however, should be capable of withstanding temperatures up to about 350° F., and pressure differentials up to about 10,000 psi.

The anchoring and sealing system 200 also includes a set of energizing rings 220, 225. Each energizing ring 220, 225 is an annular member disposed about the body 306 adjacent each end of the sealing member 210. The energizing rings 220, 225 have a tapered surface and a substantially flat surface. The flat surface abuts the sealing member 210 while the tapered surface contacts a first surface of a set of expansion rings 230, 235.

The expansion rings 230, 235 in the sealing system 200 are disposed adjacent the energizing rings 220, 225. The expansion rings 230, 235 may be manufactured from any flexible plastic, elastomeric, or resin material which flows at a predetermined temperature, such as TEFLON® for example. The expansion rings 230, 235 expands radially outward from the mandrel 305 and flows across the outer surface of the mandrel 305 providing an effective seal for the sealing system 200 as will be explained below. The expansion rings 230, 235 have a first surface and a second surface. The second surface of the expansion rings 230, 235 complement a first surface 244 of the support ring 240, 245 as illustrated in FIG. 3.

Figure 3:
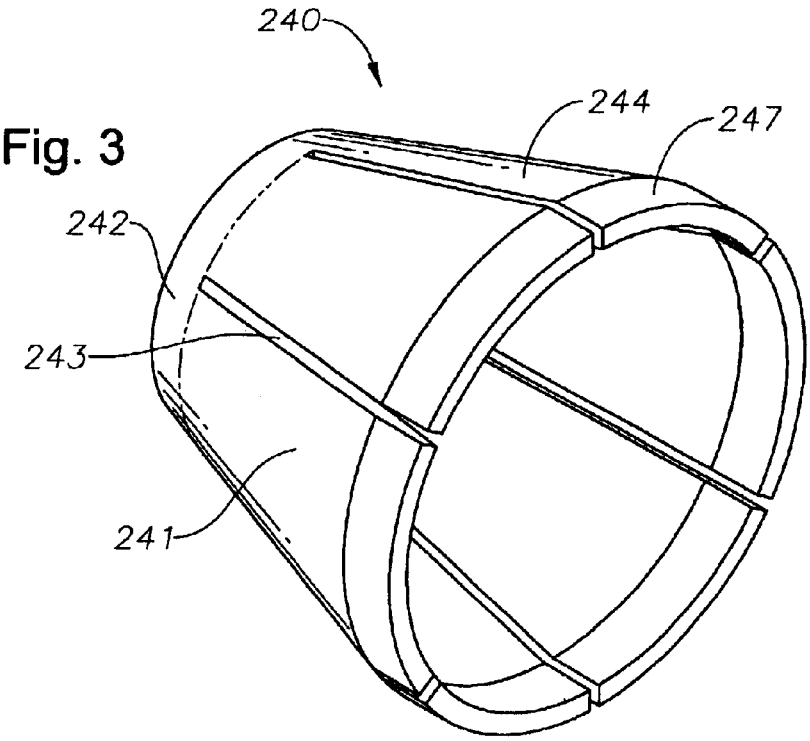
FIG. 3 is an enlarged isometric view of a support ring for the sealing system of FIG. 2.

FIG. 3 is an enlarged isometric view of a support ring 240, 245. As shown, the support ring 240, 245 is a conical-shaped tubular member. There is a first end 242 having a first diameter, a second tapered end 247 having a larger diameter. The second end 247 is divided into wedges 241 by longitudinal cuts 243 which terminate at the first end 242. The number of cuts 243 is determined by the size of the annulus to be sealed and the forces exerted on the support ring 240, 245. The wedges 241 are angled outwardly between the first 242 and second 247 ends axis of the support ring 240, 245 at about 10 degrees to about 30 degrees to form a ramped or tapered surface. Preferably, this angle of the wedges 241 complement the second surface of the expansion rings 230, 235 as illustrated in FIG. 2.

As shown on FIG. 2, the sealing system 200 further includes a set of slips 310, 315. The slips 310, 315 are disposed adjacent the respective support rings 240, 245. The slips 310, 315 are arranged to at least partially overlap the support rings 240, 245. In one embodiment, an inner surface of the slips 310, 315 are tapered to complement the outer surface of the support rings 240, 245. An outer surface of the slips 310, 315 preferably includes at least one outwardly extending serration or edged tooth to engage an inner surface of the surrounding casing 330 when the slips 310, 315 are driven radially outward from the mandrel 305. Slip 315 abuts against the shoulder 308 formed in the mandrel 305 and does not substantially move axially. On the other hand, slip 310 abuts the setting ring 340 and moves with the setting ring 340 when an axial force is applied.

The slips 310, 315 are designed to fracture with radial stress. The slips 310, 315 typically includes at least one recessed longitudinal groove (not shown) milled therein to fracture under stress, thereby allowing the slips 310, 315 to expand outwards to engage an inner surface of the surrounding tubular. For example, the slips 310, 315 may each include four sloped segments separated by equally spaced recessed grooves. Under stress, the segments separate at the grooves and expand to contact the surrounding tubular. Preferably, the segments become evenly distributed about the outer surface of the mandrel 305 after expansion.

As illustrated on FIG. 2, the sealing apparatus 300 further includes the setting ring 340. The setting ring 340 abuts a first end of slip 310. The setting ring 340 is a member having a substantially flat surface 342 at one end. The surface 342 serves as a shoulder that abuts a setting tool (not shown).

Additionally, the sealing apparatus 300 includes the top ring 350. The top ring 350 is disposed adjacent the surface 342 of the setting ring 340. In the embodiment shown, the top ring 350 is secured to the mandrel 305 by a plurality of pins 345. However, the top ring 350 could be secured to the mandrel 305 by pins, glue, thread, or combinations thereof. The top ring 350 is a member having a smaller outer diameter than the setting ring 340. The smaller outer diameter allows the top ring 350 to fit within the inner diameter of a setting tool so that the setting tool can be mounted against the surface 342 of the setting ring 340.

Figure 4:
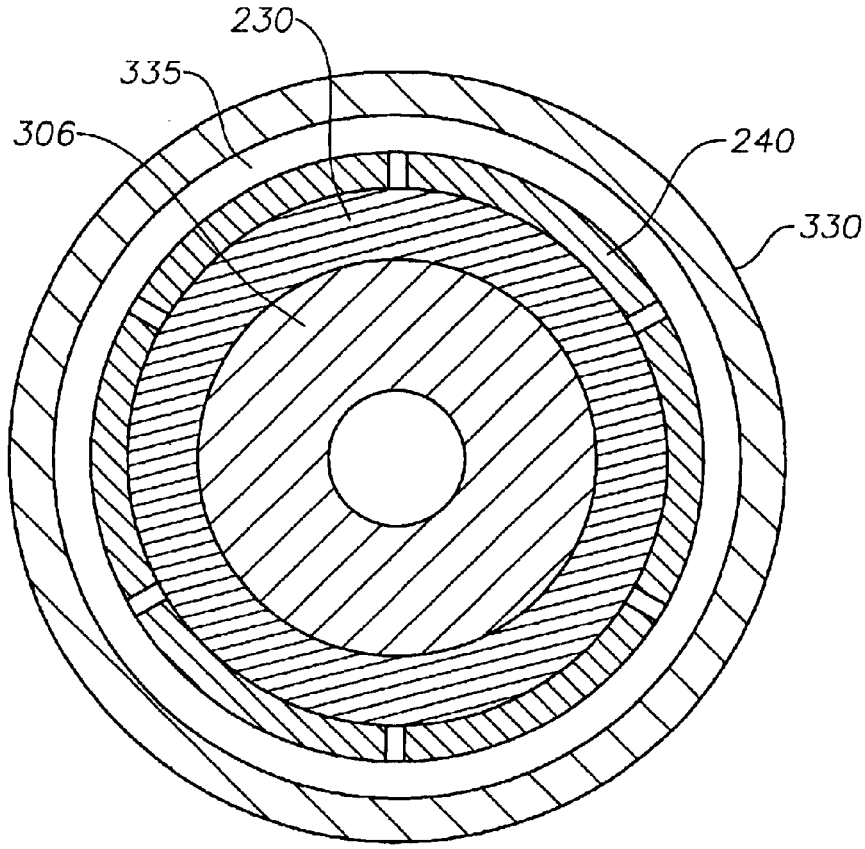
FIG. 4 is a cross-sectional view of the sealing apparatus along line 4—4 of FIG. 2.

FIG. 4 is a cross-sectional view of the sealing apparatus 300 along line 4—4 of FIG. 2. As illustrated, the body 306 is the center support member for the sealing apparatus 300. The expansion ring 230 and the support ring 240 are disposed around the body 306. FIG. 4 further illustrates an annulus 335 that is created between the sealing system 200 and the casing 330.

Figure 5:
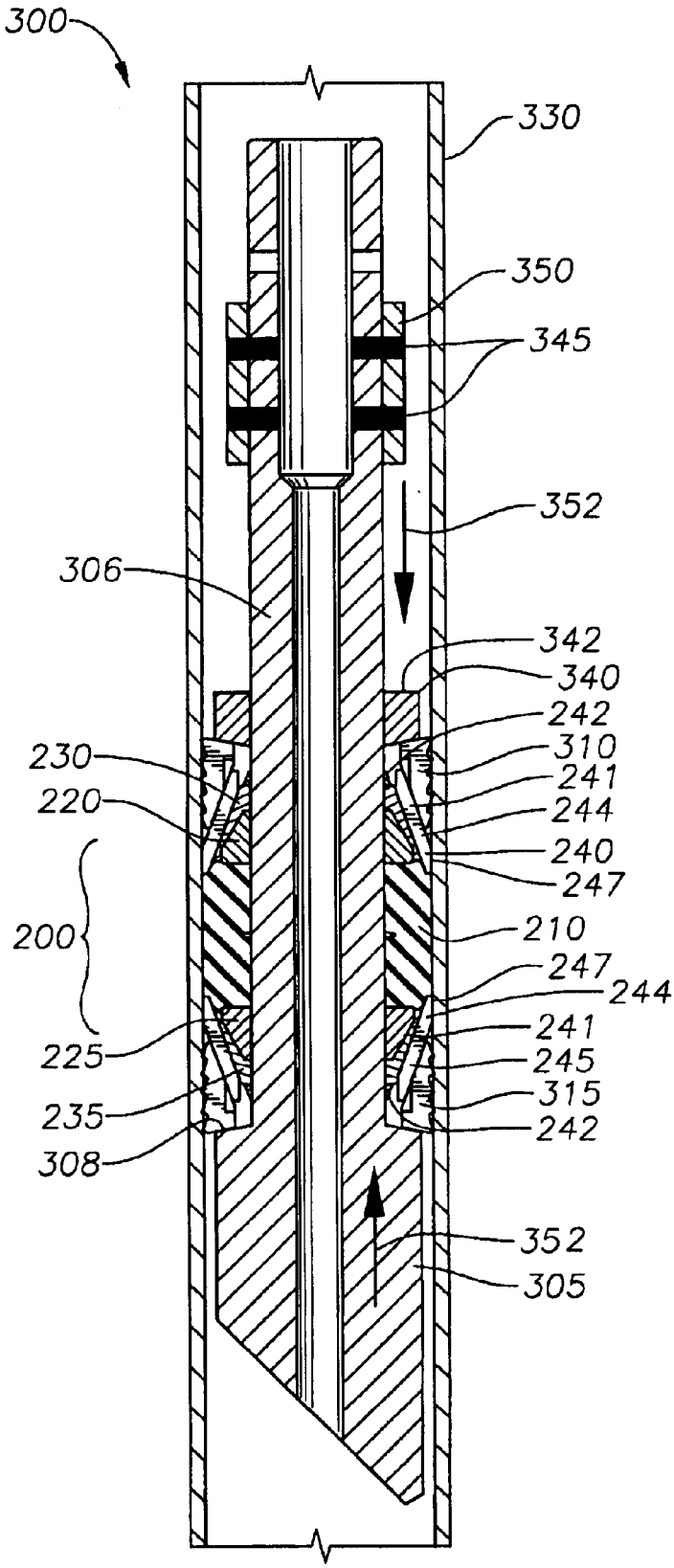
FIG. 5 is a longitudinal section view of the sealing apparatus of FIG. 2, after the anchoring and sealing system is activated.

FIG. 5 is a longitudinal section view of the sealing apparatus 300 of FIG. 2, after the anchoring and sealing system 200 is activated. The sealing system 200 is activated using an axial downward force applied through the outer movable portion of the setting tool (not shown) to the setting ring 340. The axial force causes the sealing system 200 to move axially relative to the mandrel 305. Consequently, the sealing system 200 is compressed between the setting ring 340 and the shoulder 308. The compressive forces cause the sealing element 210 to radially expand toward the surrounding casing 330. Specifically, the compressive forces include a force from the setting tool in a first direction as illustrated by arrow 352 that is exerted against the surface 342 of the support ring 240. Also a force from the shoulder 308 in a second direction as illustrated by arrow 254 is exerted against a backend of slip 315. The forces in the first and second opposing directions cause the support rings 240, 245 to move along the tapered surface of the expansion rings 230, 235. The first surface 244 of the support rings 240, 245 expand radially from the mandrel 305 while the wedges 241 hinges radially toward the surrounding casing 330. The wedges 241 will break away or separate from the second surface 242 of the support rings 240, 245. The wedges 241 then extend radially outward to engage the surrounding casing 330. This radial extension allows a tapered edge 247 of the wedges 241 to contact the inner wall of the surrounding casing 330. Therefore, an additional amount of friction is generated against the surrounding casing 330, thereby containing the sealing member 210 within a specific region in the wellbore.

The compressive force causes the expansion rings 230, 235 to flow and expand under high temperature and/or pressure conditions. As the expansion rings 230, 235 are forced across the tapered surface of the energizing rings 220, 225 they flow and expand, filling any gaps or voids between the wedges 241 of the support rings 240, 245. The expansion of the expansion rings 230, 235 also applies a collapse load through the energizing rings 220, 225 on the body 306 of the mandrel 305. This helps prevent axial slippage of the sealing system 200 components once the sealing system 200 is activated in the wellbore. The collapse load also prevents the energizing rings 220, 225 and sealing member 210 from rotating during the milling operation, thereby reducing the required time to complete the mill up operation. The energizing rings 220, 225 then transfer the axial force to the sealing member 210 to compress and expand the sealing member 210 radially. The expanded sealing member 210 effectively seals, or "packs off", an annulus formed between the sealing apparatus 300 and an inner diameter of a surrounding casing 330.

Figure 6:
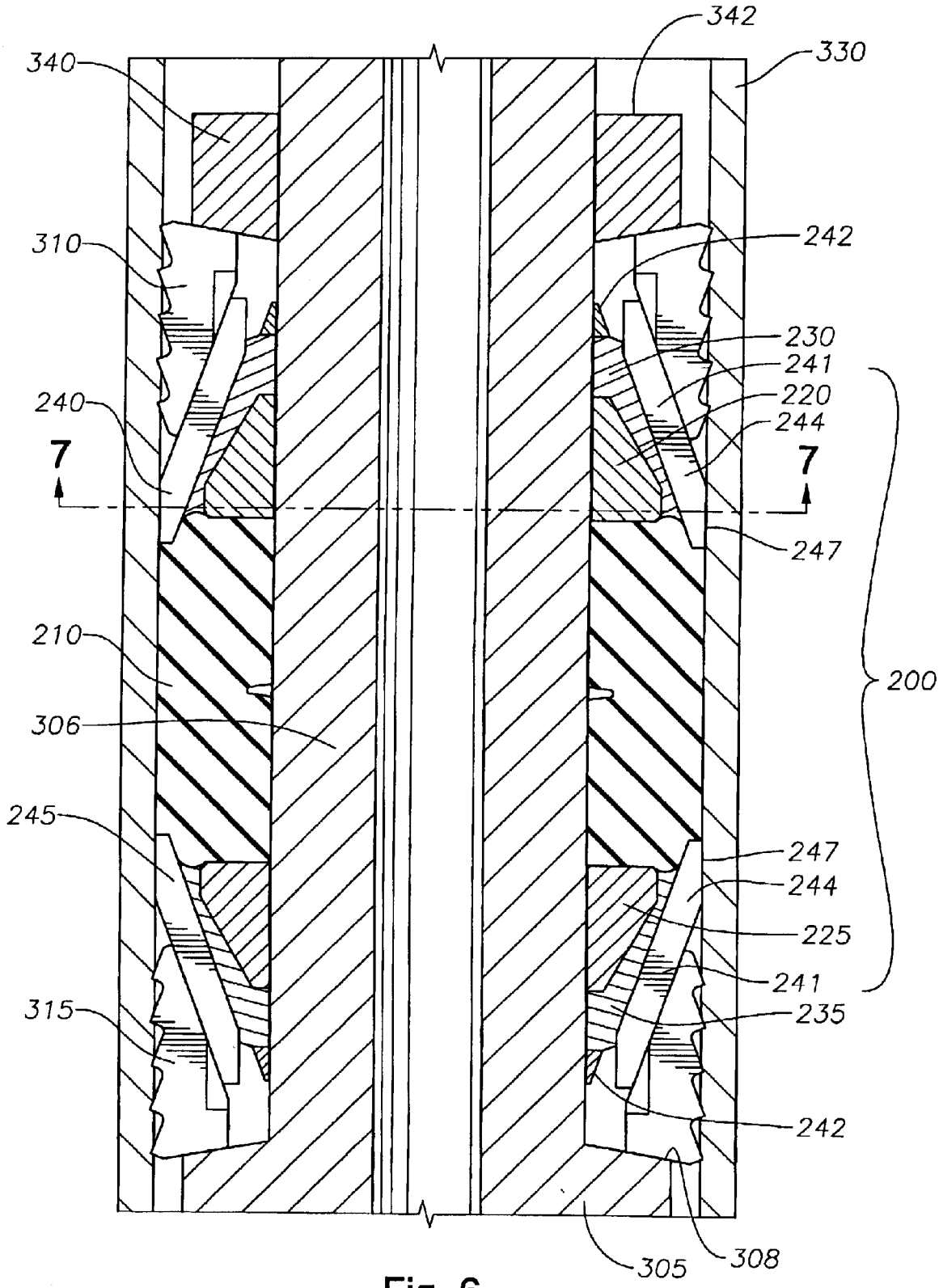
FIG. 6 is an enlarged cross-sectional view of the apparatus of FIG. 5, illustrating more fully the sealing member engaged against the casing.

FIG. 6 is an enlarged cross-sectional view of the apparatus 300 of FIG. 5, illustrating more fully the sealing member 210 engaged against the casing 330. The downward force exerted against the setting ring 340 causes the expansion rings 230, 235 to flow and expand, filling any gaps or voids between the support rings 240, 245. At the same time, the downward force is transmitted to the slips 310, 315. The slips 310, 315 move along the tapered surface of the support ring 240, 245, and contact an inner surface of a surrounding casing 330. The axial and radial forces applied to slips 310, 315 cause the recessed grooves to fracture into equal segments, permitting the serrations, or "teeth" of the slips 310, 315 to firmly engage the inner surface of the surrounding casing 330.

Figure 7:
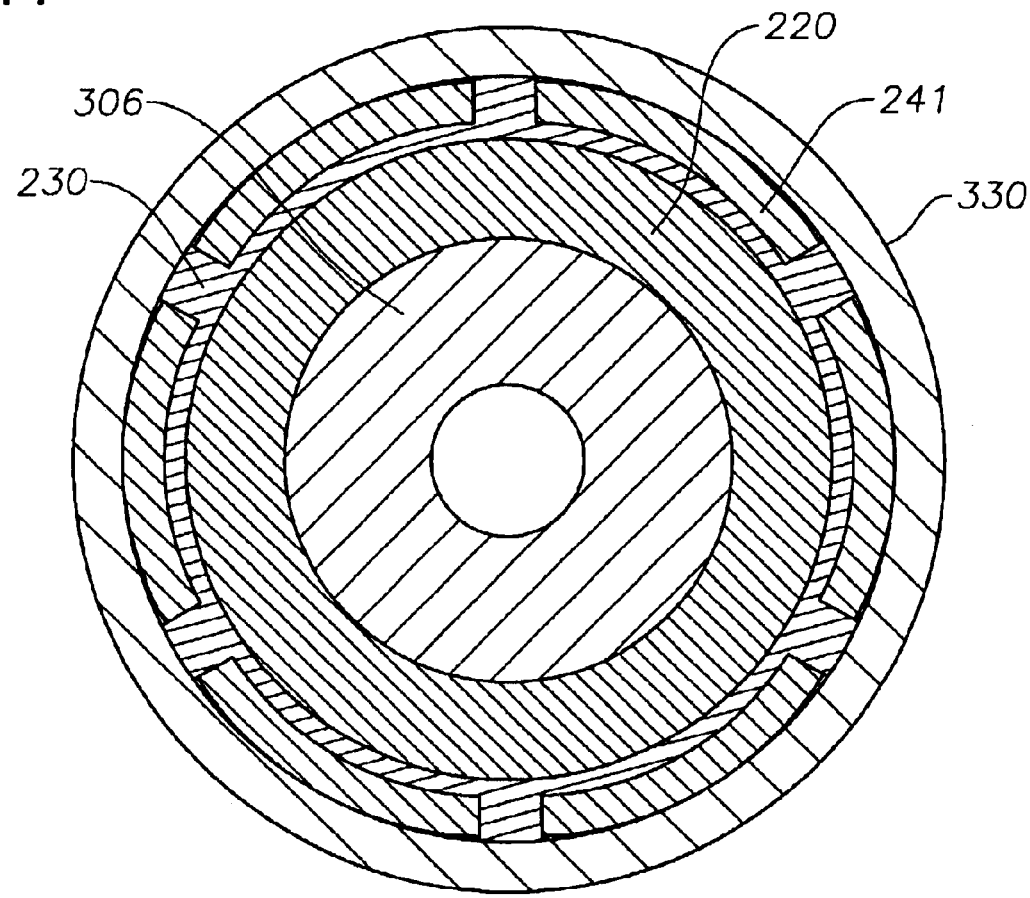
FIG. 7 is a cross-sectional view of the sealing apparatus of FIG. 6, taken along line 7—7.

FIG. 7 is a cross-sectional view of the sealing apparatus 300 of FIG. 6, taken along line 7—7. As shown, the expansion ring 230 expands and fills the gaps or voids between the wedges 241 of the support ring 240. This expansion allows the sealing system 200 to become a seal tight unit.

In operation, the sealing apparatus 300 may be installed in a wellbore with some non-rigid system, such as electric wireline or coiled tubing. A setting tool, such as a Baker E-4 Wireline Setting Assembly commercially available from Baker Hughes, Inc., for example, connects to an upper portion of the mandrel 305. Specifically, an outer movable portion of the setting tool is disposed about the outer diameter of the top ring 350, abutting the surface 342 of the setting ring 340. An inner portion of the setting tool is fastened about the outer diameter of the top ring 350. The setting tool and sealing apparatus 300 are then run into the well to the desired depth where the sealing apparatus 300 is to be installed.

To expand the sealing apparatus 300 into the casing, the top ring 350 is held by the wireline, through the inner portion of the setting tool. An axial force in the first direction is applied through the outer movable portion of the setting tool to the surface 342 of the setting ring 340. At the same time, an axial force from the mandrel 305 in a second direction is exerted against the backend of slip 315. The axial forces cause the outer portions of the sealing apparatus 300 to move axially relative to the mandrel 305, thereby exerting force on the sealing system 200. As the opposing forces are exerted on the sealing system 200, the malleable outer portions of sealing system 200 compress and radially expand toward the surrounding casing 330.

While the foregoing is directed to embodiments of the present invention, other and further embodiments of the invention may be devised without departing from the basic scope thereof, and the scope thereof is determined by the claims that follow.

What is claimed is:

1. An anchoring and sealing system for use in a downhole tool, comprising:

a compressible sealing member;

a segmented ring member at each end of the sealing member, each segmented ring member having a tapered outer surface and a lesser tapered end portion at a larger end thereof for contacting a wellbore surface; and a slip member adjacent to each segmented ring member, the slip member radially movable outwardly along the tapered outer surface of the segmented ring member and into frictional contact with the wellbore surface.

2. The anchoring and sealing system of claim 1, further includes an energizing ring disposed between the segmented ring member and the sealing member.

3. The anchoring and sealing system of claim 2, further includes a deformable expansion ring adjacent to each energizing ring.

4. The anchoring and sealing system of claim 3, wherein each expansion ring comprises a flexible fiber filled material that flows at a predetermined temperature.

5. The anchoring and sealing system of claim 3, wherein each segmented ring member and energizing ring comprises an epoxy blend reinforced by glass fibers stacked in layers angled at about 30 to about 70 degrees.

6. The anchoring and sealing system of claim 3, wherein each segmented ring member includes one or more tapered wedges, whereby activating the anchoring and sealing system extends the tapered wedges into contact with an area of a wellbore.

7. The anchoring and sealing system of claim 6, wherein activating the anchoring and sealing system causes the expansion ring to flow and fill a gap between extended wedges.

8. The anchoring and sealing system of claim 7, wherein each energizing ring includes a tapered first surface and a substantially flat second surface.

9. The anchoring and sealing system of claim 8, wherein the second surface of each energizing ring acts upon the sealing member upon activating the anchoring and sealing system.

10. A downhole tool, comprising:

a body; and an anchoring and sealing system disposed about the body, wherein the anchoring and sealing system comprises:

a sealing member;

an energizing ring member disposed at each end of the sealing member;

an expansion ring adjacent to each energizing ring;

a support ring adjacent to each expansion ring, wherein each ring member has a tapered outer surface and a lesser tapered end portion at a larger end thereof for contacting a wellbore surface; and a slip member adjacent to each support ring, whereby activating the anchoring and sealing system causes the slip member to move radially outward along the tapered outer surface of the support rings and the seal member to expand outward.

11. The tool of claim 10, wherein the energizing ring member comprises an epoxy blend reinforced by glass fibers stacked in layers angled at about 30 to about 70 degrees.

12. The tool of claim 10, wherein the body comprises an epoxy blend reinforced by glass fibers stacked in layers angled at about 30 to about 70 degrees.

13. The tool of claim 10, wherein the support ring comprises an epoxy blend reinforced by glass fibers stacked in layers angled at about 30 to about 70 degrees.

14. The tool of claim 10, wherein the expansion rings comprise a flexible fiber filled material that flows at a predetermined temperature.

15. The tool of claim 10, wherein the support ring includes one or more tapered wedges, whereby activating the anchoring and sealing system the tapered wedges engage into contact with an area of a wellbore.

16. The tool of claim 15, wherein activating the anchoring and sealing system causes the expansion ring to flow and fills a gap between the extended wedges.

17. The tool of claim 10, wherein the energizing rings includes a tapered first surface and a substantially flat second surface.

18. The tool of claim 17, wherein the second surface of the energizing ring acts upon the sealing member upon activating the downhole tool.

19. The tool of claim 10, wherein the tool is a bridge plug.

20. The tool of claim 10, wherein the tool is a packer.

21. A method for sealing a wellbore, comprising:

running a tool into the wellbore, the tool comprising:

a body;

a setting ring; and an anchoring and sealing system disposed about the body, the anchoring and sealing system includes:

a sealing member;

a energizing ring member at each end of the sealing member;

a deformable expansion ring adjacent each energizing ring;

a support ring including one or more tapered wedges; and a slip member adjacent each support ring;

applying an axial force on the setting ring to cause the setting ring to move axially on the body and act against the slip member;

compressing the sealing member to expand in contact with an area of the wellbore;

urging the slip member radially outward along an outer surface of the support ring, whereby the slip member supports the sealing member;

expanding the support ring and separating the one or more tapered wedges;

deforming the expansion ring to fill the gaps between the one or more tapered wedges; and urging the energizing ring axially toward the sealing member.

22. The method of claim 21, wherein urging the slip member radially outward forces the slip member into contact with an area of the wellbore.

23. The method of claim 21, wherein the energizing ring member and the support ring comprises a filament wound composite material.

24. The method of claim 23, wherein the filament wound composite material comprises an epoxy blend reinforced by glass fibers stacked in layers angled at about 30 to about 70 degrees.

25. The method of claim 24, wherein deforming the expansion ring causes the expansion ring to create a collapse load on the energizing ring, thereby holding the energizing ring firmly against the body.

26. The method of claim 21, wherein the expansion ring comprise a flexible fiber filled material that flows at a predetermined temperature.

* * * * *

UNITED STATES PATENT AND TRADEMARK OFFICE

CERTIFICATE OF CORRECTION

PATENT NO. : 6,769,491 B2
APPLICATION NO. : 10/165613
DATED : August 3, 2004
INVENTOR(S) : Patrick Zimmerman, Rocky A. Turley and Rami Al Oudat It is certified that error appears in the above-identified patent and that said Letters Patent is hereby corrected as shown below:

In Claims:

Please insert the following claims after Claim 26, Column 10:

27. An anchoring and sealing system for use in a downhole tool, comprising:

a compressible sealing member;

a ring member at each end of the sealing member, each ring member having an outwardly tapered outer surface and an outwardly tapered inner surface; and a slip member adjacent to each ring member, whereby activating the anchoring and sealing system expands the sealing member and causes the slip member to move along the outwardly tapered outer surface and into frictional contact with a wellbore surface.

28. The anchoring and sealing system of claim 27, further including a supporting member disposed adjacent the outwardly tapered inner surface.

Signed and Sealed this

Eighth Day of August, 2006

JON W. DUDAS
*Director of the United States Patent and Trademark Office*